United States Patent [19]

Mifune et al.

[11] 4,334,014

[45] Jun. 8, 1982

[54] SILVER HALIDE PHOTOGRAPHIC LIGHT-SENSITIVE ELEMENTS

[75] Inventors: Hiroyuki Mifune; Tadao Shishido; Shoji Ishiguro, all of Minami-ashigara; Jisaburo Ueyanagi, Nishinomiya, all of Japan

[73] Assignee: Fuji Photo Film Co., Ltd., Kanagawa, Japan

[21] Appl. No.: 244,993

[22] Filed: Mar. 18, 1981

[30] Foreign Application Priority Data

Mar. 18, 1980 [JP] Japan ..... 55-34379

[51] Int. Cl.[3] ..... G03C 1/34

[52] U.S. Cl. ..... 430/611; 430/600; 430/614

[58] Field of Search ..... 430/611, 614, 600, 564

[56] References Cited

U.S. PATENT DOCUMENTS 2,860,985 11/1958 Dann et al. ..... 430/611

FOREIGN PATENT DOCUMENTS 1389089 4/1975 United Kingdom ..... 430/611

*Primary Examiner*—Won H. Louie, Jr.

*Attorney, Agent, or Firm*—Sughrue, Mion, Zinn, Macpeak and Seas

[57] ABSTRACT

A silver halide photographic light-sensitive element is described containing a cephalosporin compound in its silver halide emulsion layer of substantially the surface latent image type, or in its hydrophilic colloid layer. This light-sensitive element is prevented in the latent image fading.

10 Claims, No Drawings

SILVER HALIDE PHOTOGRAPHIC LIGHT-SENSITIVE ELEMENTS

BACKGROUND OF THE INVENTION

This invention relates to a silver halide light-sensitive element, and more particularly to a silver halide photographic light-sensitive element which is capable of providing a very stable latent image (in other words, a reduction in latent image regression).

As is known in the art, the formation of an image according to a silver halide photographic method requires a projection light-exposure process to form a latent image and a development processing process to convert the latent image thus-formed into the corresponding silver or dye image (see, for example, Mees & James, *The Theory of the Photographic Process,* 4th Ed., 1977).

The formation of a latent image according to the projection light-exposure process results from extremely small changes in silver halide crystals when considered from a chemical standpoint, and the latent image itself is somewhat unstable. Over a period from the time of the projection light-exposure process to the time of the development processing process, the intensity of the latent image is liable to decrease. This phenomenon is generally called "latent image fading". The rapidity of the latent image fading varies generally depending on the conditions under which an exposed light-sensitive element is stored; for example, when the exposed light-sensitive element is stored at a high temperature, the latent image fading is generally significant, whereas when stored at a low temperature, it is generally less significant.

One simplified method for overcoming disadvantages resulting from the latent image fading is to carry out the development processing immediately after the projection light-exposure, and a second simplified method is to store the exposed light-sensitive element at a low temperature. Although these methods are the easiest from a chemical standpoint, they are often not convenient for the user. Negative elements and reversal elements are often allowed to stand at room temperature for several months after light-exposure before they are subjected to the development processing. Even with positive elements for duplication, it is sometimes allowed to stand for several months.

It is therefore desirable to prepare a light-sensitive element which is capable of providing a stable latent image by application of a specific procedure in the course of the production thereof. In order to obtain such light-sensitive elements, various methods have heretofore been proposed, including a light-sensitive element as disclosed in West German Pat. No. 1,170,508 in which a hydroxy group-substituted aromatic compound is used, a light-sensitive element as disclosed in U.S. Pat. No. 3,447,926 in which 1,3-diones are used, a light-sensitive element as disclosed in U.S. Pat. No. 3,318,702 in which nitrilotriacetic acid, etc., are used, a method as disclosed in West German Pat. No. 1,173,339, and a method as disclosed in U.S. Pat. No. 3,424,583.

Further, the use of penicillin derivatives in photographic emulsions has been proposed to reduce latent image regression (British Pat. No. 1,389,089).

It has been found, however, that these known methods fail to provide light-sensitive elements which are completely satisfactory with respect to the latent image fading, and further improved stability would be desirable.

SUMMARY OF THE INVENTION

As a result of extensive studies on the latent image fading, it has now been found that cephalosporins can provide the effect of greatly reducing latent image fading.

This invention, therefore, provides a silver halide photographic light-sensitive element comprising a support and at least one substantially surface latent image type of silver halide emulsion layer, wherein a cephalosporin compound is incorporated in the silver halide emulsion layer or another hydrophilic colloid layer.

The term "cephalosporin compound" is recognized in the art as collectively referring to compounds containing the following moiety:

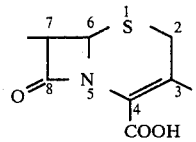

DETAILED DESCRIPTION OF THE INVENTION

Preferred cephalosporins which can be used in this invention can be represented by formula (I)

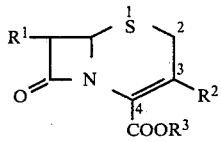

(I)

wherein $R^1$ represents an amino group (including a substituted amino group);

$R^2$ can represent hydrogen, a halogen group, an amino group, a hydroxy group, a mercapto group, an alkyl group, an alkoxy group, an aryloxy group, an alkylthio group, an arylthio group, an acyloxy group, an acylthio group, a heterocyclic group, or a formyl group (including substituted groups); and $R^3$ can represent hydrogen, an alkali metal ion, an ammonium ion, a hydrocarbon group, or a heterocyclic group (including substituted groups); or $R^2$ and $R^3$ together can represent a group completing an oxygen-containing heterocyclic group.

The term "hydrocarbon" described above includes any hydrogen and carbon-containing group.

Preferred substituted amino groups for $R^1$ include amino groups substituted with amino protective groups such as an acyl group, a hydrocarbon group, etc. The term "amino protective group" is used in the field of synthesis chemistry and art-recognized but will hereafter be explained in greater detail.

Hydrocarbon group which may be used as the substituent include all saturated or unsaturated mono- or divalent hydrocarbon groups, such as a straight or branched chain alkyl group, e.g., a methyl group, an ethyl group, a propyl group, an isopropyl group, a butyl group, an isobutyl group, a tert-butyl group, an alkenyl, aralkenyl or alkylene group, e.g., a vinyl group, an allyl group, a 1-propenyl group, a methylene group, an ethylidene group, a propylidene group, and a benzylidene group. These divalent hydrocarbon groups may be substituted by halogen, a hydroxy group, a mono- or dialkylamino group (e.g., a methylamino group, a dimethylamino group, a diethylamino group, and a methylethylamino group), an alkylarylamino group (e.g., a methylphenylamino group, and an ethylphenylamino group), a diarylamino group (e.g., a diphenylamino group, and a ditolylamino group), a heterocyclic group (e.g., a pyrrolidinyl group, a piperidino group, and a hexahydro-1H-azovinyl group), an acylamino group, an alkoxy group (e.g., a methoxy group, an ethoxy group, and a propoxy group), a nitro group, a carboxy group, and an esterified carboxy group (e.g., a methoxycarbonyl group, an ethoxycarbonyl group, an isopropoxycarbonyl group, a benzyloxycarbonyl group, and a phenethyloxycarbonyl group).

In the foregoing and following definitions for $R^1$, $R^2$ and $R^3$, unless otherwise indicated, groups of aliphatic nature have 1 to 18 carbon atoms in total, preferably 1 to 12 carbon atoms, groups of aromatic nature have 6 to 18 carbon atoms in total, groups of alicyclic nature have 5 to 18 carbon atoms in total, and heterocyclic groups are 5- to 7-membered wherein the hetero atom is N, S or O, and can be fused or condensed rings.

The acyl group which may be used as the substituent for the substituted amino group can be any of an aliphatic acyl group, an acyl group containing an aromatic ring, or an acyl group containing a heterocyclic ring. The aliphatic acyl group may be a saturated or unsaturated alkanoyl group, may have a side chain or chains, and may be cyclic.

Specific examples of such aliphatic acyl groups include a formyl group, an acetyl group, a propyonyl group, a butyryl group, an isobutyryl group, a valeryl group, an isovaleryl group, a pivaloyl group, an acryloyl group, a crotonoyl group, a 2-methylacryloyl group, a cyclohexylcarbonyl group, a cycloheptylcarbonyl group, a cyclopentylacetyl group, a cyclohexylacetyl group, a cycloheptylacetyl group, a cyclohexylpropionyl group, a cycloheptylpropionyl group, a dihydrobenzoyl group, a 2,4,6-cycloheptatrienylacetyl group, and a dihydrophenylacetyl group.

The saturated or unsaturated alkanoyl groups may contain therein an oxygen atom or a sulfur atom. Examples of such oxygen or sulfur-containing alkanoyl groups include a methoxyacetyl group, a methylthioacetyl group, a 2-propenylthioacetyl group, a cyclohexylthioacetyl group, a cyclohexyloxyacetyl group, a dihydrophenoxyacetyl group, a dihydrophenylthioacetyl group, a cyclopentyloxycarbonyl group, a cyclohexyloxycarbonyl group, a dihydrophenoxycarbonyl group, and a cycloheptyloxycarbonyl group.

The acyl group containing an aromatic ring can be an arylcarbonyl group (e.g., a benzoyl group, a toluoyl group, a naphthoyl group, an α-methylnaphthoyl group, a phthaloyl group, and a tetrahydronaphthoyl group) or an aralkanoyl group (e.g., a phenylacetyl group, a phenylpropionyl group, a phenylbutyryl group, a tolylacetyl group, a xylylacetyl group, a naphthylacetyl group, and a tetrahydronaphthylacetyl group).

A carbon atom contained in the alkyl portion of these aralkanoyl groups may be replaced by an oxygen atom or a sulfur atom, i.e., the aromatic ring-containing acyl group can be an aryloxyalkanoyl group, an arylthioalkanoyl group, an aralkoxycarbonyl group and an aryloxycarbonyl group. Examples of these groups include a phenoxyacetyl group, a phenylthioacetyl group, a benzyloxycarbonyl group, a phenoxycarbonyl group, a 2-phenoxypropionyl group, and a 2-phenoxybutyryl group.

Examples of acyl groups containing a heterocyclic ring include heterocyclic carbonyl groups containing a saturated or unsaturated single or fused heterocyclic ring containing at least one hetero atom (e.g., an oxygen atom, a sulfur atom, and a nitrogen atom), such as a thienyl group, a furyl group, a pyranyl group, a 5,6-dihydro-2H-pyranyl group, an isobenzofuranyl group, a chromenyl group, a xanthenyl group, a 2H-pyrrolyl group, a 3H-pyrrolyl group, a pyrrolyl group, an imidazolyl group, a pyrazolyl group, a pyridyl group, a pyrimidinyl group, a pyradinyl group, a pyridadinyl group, an isoindolyl group, an indolyl group, an indazolyl group, a quinolyl group, an isoquinolyl group, an isoxazolyl group, an isothiazolyl group, an oxadiazolyl group, a pyrrolidinyl group, a pyrrolinyl group, an imidazolidinyl group, a piperidinyl group, a piperazinyl group, a diazolyl group, a trialzolyl group, an oxazolyl group, a thiazolyl group, a thiadiazolyl group, a tetrazolyl group, a benzoxazolyl group, a benzoxadiazolyl group, a benzothiazolyl group, a benzothiadiazolyl group, a benzotriazolyl group, a benzimidazolyl group, and a sydonoyl group, and alkanoyl groups (e.g., an acetyl group, a propionyl group, a butyryl group, an acryloyl group, and a crotonoyl group) containing as a substituent the above-described heterocyclic ring, a heterocyclic oxy group, a heterocyclic thio group, a heterocyclic substituted amino group, an N-alkyl-N-heterocyclic ring-substituted amino, or the like, such as a 1H (or 2H)-tetrazolylacetyl group, a thienylacetyl group, a thienylpropionyl group, a furylacetyl group, a piperadinylacetyl group, a pyrrolidinylacetyl group, a pyrrolidinylpropionyl group, a benzothiazolylacetyl group, an oxazolylacetyl group, a thiazolylacetyl group, a benzoxazolylacetyl group, a furyloxyacetyl group, a 4-pyridylthioacetyl group, a thienylaminoacetyl group, an N-methyl-N-thienylaminoacetyl group, etc.

A carbon atom contained in the alkyl portion of the alkanoyl group containing the above heterocyclic ring as a substituent may be replaced by an oxygen atom or a sulfur atom. In other words, the substituted acyl group also includes an alkoxycarbonyl or alkylthiocarbonyl group in which the alkyl portion is substituted with the above heterocyclic ring and is exemplified by a pyridylmethoxycarbonyl group, a 2-furyloxycarbonyl group and an 8-quinolyloxycarbonyl group.

These aliphatic acyl groups, aromatic ring-containing acyl groups and heterocyclic ring-containing acyl groups may have one or more substituents at any desired position or positions. Substituents which can be used include an alkyl group, such as a methyl group, an ethyl group, a propyl group, an isopropyl group, a 1-propenyl group, a 2-propenyl group, a cyclopropyl group, a cyclopentyl group, a cyclohexyl group, and a cycloheptyl group, an alkoxy group, such as a methoxy group, an ethoxy group, a propoxy group, and an isopropoxy group, an alkylthio group, such as a methylthio group, and an ethylthio group, an aryl group, such as a phenyl group, a xylyl group, and a tolyl group, an aralkyl group, such as a benzyl group, and a phenethyl group, an amino group, a nitro group, an azido group, a cyano group, a halogen, such as chlorine, fluorine, and bromine, a carboxy group, a sulfo group, a hydroxy group, a hydroxyamino group, and a mono- or dialkylamino group, such as a mono- or dimethylamino group, a mono- or diethylamino group, a mono- or dipropylamino group, and a mono- or diisopropylamino group.

Examples of such aliphatic acyl groups, aromatic ring-containing acyl groups, and heterocyclic ring-containing acyl groups include a cyanoacetyl group, a 5-amino-5-carboxybutyryl group, a phenoxyacetyl group, an acetoacetyl group, a chloroacetyoacetyl group, an α-phenoxypropionyl(2-aminothiazolin-4-yl)acetyl group, an α-aminophenylacetyl group, a mandelyl group, an α-sulfophenylacetyl group, an α-carboxyphenylacetyl group, a 3-phenyl-5-methyl-4-oxazolylcarbonyl group, a 2-amino-2-(5,6-dihydro-2H-pyran-3-yl)acetyl group, a 2-amino-2-(p-hydroxyphenyl)acetyl group, a 2,6-dimethoxybenzoyl group, a 3-phenyl-5-methyl-4-oxazolylcarbonyl group, a 3-(2-chlorophenyl)-5-methyl-4-oxazolylcarbonyl group, a 3-(2,6-dichlorophenyl)-5-methyl-4-oxazolylcarbonyl group, and a 3-(2-chloro-6-fluorophenyl)-5-methyl-4-oxazolylcarbonyl group.

Amino protective groups other than the above acyl group which can be used as the substituent for the substituted amino group of $R^1$ include a trityl group, a 2-nitrophenylthio group, a 2,4-dinitrophenylthio group, a benzylidene group, a 4-nitrobenzylidene group, a 2-hydroxybenzylidene group, a 2-hydroxy-5-chlorobenzylidene group, a 2-hydroxy-1-naphthylmethylene group, a 3-hydroxy-4-pyridylmethylene group, a piperidinomethylene group, a 1-methoxycarbonyl-2-propilidene group, a 1-ethoxycarbonyl-2-propilidene group, a 3-ethoxycarbonyl-2-butylidene group, a 1-acetyl-2-propylidene group, a 1-benzoyl-2-propylidene group, a 1-[N-(2-methoxyphenyl)-carbamoyl]-2-propylidene group, a 1-[N-(4-methoxyphenyl)carbamoyl]-2-propylidene group, a 2-ethoxycarbonylcyclohexylidene group, a 2-ethoxycarbonylcyclopentylidene group, a 2-acetylcyclohexylidene group, and a 3,3-dimethyl-5-oxocyclohexylidene group. Among these groups, for example, the 1-methoxycarbonyl-2-propylidene group and 2-ethoxycarbonylcyclohexylidene group are sometimes referred to as a 1-methoxycarbonyl-1-propene-2-yl group and a 2-ethoxycarbonyl-1-cyclohexenyl group, respectively.

Additionally, a di- or trialkylsilyl group, a methanesulfonyl group, a benzenesulfonyl group, etc., can be used as such amino protective groups.

When the substituent of the substituted amino group of $R^1$ contains therein a free amino, hydroxy, carboxy, sulfo, or like group, those compounds in which such amino, hydroxy, carboxy, sulfo or like groups are protected by a protective group are included within the scope of this invention.

As protective groups for the amino group, any known amino protective group can be employed. Typical examples of such amino protective groups are easily releasable acyl groups, such as a trichloroethoxycarbonyl group, a tribromoethoxycarbonyl group, a benzyloxycarbonyl group, a p-toluenesulfonyl group, a p-nitrobenzyloxycarbonyl group, an o-bromobenzyloxycarbonyl group, an o-nitrophenylsulfonyl group, a formyl group, a vinyloxycarbonyl group, a tert-butoxycarbonyl group, a p-methoxybenzyloxycarbonyl group, a 3,4-dimethoxybenzyloxycarbonyl group, a 4-(phenylazo)benzyloxycarbonyl group, a 4-(4-methoxyphenylazo)benzyloxycarbonyl group, a 2-pyridylmethoxycarbonyl group, a 2-furyloxycarbonyl group, a diphenylmethoxycarbonyl group, a 1,1-dimethylpropoxycarbonyl group, an isopropoxycarbonyl group, a 1-cyclopropylethoxycarbonyl group, a 2-cyano-1,1-dimethylethoxycarbonyl group, a phthaloyl group, a succinyl group, a 1-adamantyloxycarbonyl group, an 8-quinolyloxycarbonyl group, and an isobornyloxycarbonyl group. Additionally, the above-described protective groups for the amino group, other than the acyl group, for example, hydrocarbon groups can be used as protective groups for the amino groups.

As protective groups for the hydroxy group, any known hydroxy protective group can be used. Examples of such hydroxy protective groups include acyl groups, such as a formyl group, an acetyl group, a benzyloxycarbonyl group, a 4-nitrobenzyloxycarbonyl group, a 4-bromobenzyloxycarbonyl group, a 4-methoxybenzyloxycarbonyl group, a 3,4-dimethoxybenzyloxycarbonyl group, a 4-(phenylazo)benzyloxycarbonyl group, a 4-(4-methoxyphenylazo)benzyloxycarbonyl group, a tert-butoxycarbonyl group, a 1,1-dimethylpropoxycarbonyl group, an isopropoxycarbonyl group, a diphenylmethoxycarbonyl group, a 2-pyridylmethoxycarbonyl group, a 2,2,2-trichloroethoxycarbonyl group, a 2,2,2-tribromoethoxycarbonyl group, an isodopropoxycarbonyl group, a 2-furfuryloxycarbonyl group, a 1-adamantyloxycarbonyl group, a 1-cyclopropylethoxycarbonyl group, and a 3-quinolyloxycarbonyl group, and a benzyl group, a trityl group, a methoxymethyl group, a 2-nitrophenylthio group, and a 2,4-dinitrophenylthio group.

Protective groups for the carboxy group which can be used include any group known for protective of the carboxy group. Examples of such carboxy protective groups include esters containing an ester portion, such as a methyl group, an ethyl group, a propyl group, an isopropyl group, a tert-butyl group, a butyl group, a benzyl group, a diphenylmethyl group, a triphenylmethyl group, a p-nitrobenzyl group, a p-methoxybenzyl group, a benzoylmethyl group, an acetylmethyl group, a p-nitrobenzoylmethyl group, a p-bromobenzoylmethyl group, a p-methanesulfonylbenzoylmethyl group, a phthalimidomethyl group, a trichloroethyl group, a tribromoethyl group, a 1,1-dimethyl-2-propenyl group, an acetoxymethyl group, a propionyloxymethyl group, a pivaloyloxymethyl group, a 1,1-dimethylpropyl group, a 1,1-dimethyl-2-propenyl group, a 3-methyl-3-butenyl group, a succinimidomethyl group, a 1-cyclopropylethyl group, a 3,5-di-tert-butyl-4-hydroxybenzyl group, a methylsulfenylmethyl group, a phenylsulfenylmethyl group, a methylthiomethyl group, a phenylthiomethyl group, a dimethylaminomethyl group, a methylsulfinylmethyl group, a di(p-methoxyphenyl)methyl group, and a 2-cyano-1,1-dimethylethyl group, and furthermore, silyl compounds, such as dimethyldichlorosilane, as described in Japanese Patent Application (OPI) No. 7073/71 (the term "OPI" as used herein refers to a "published unexamined Japanese patent application") and Dutch Laid-Open Pat. No. 7,105,259, and non-metallic compounds, such as titanium tetrachloride, as described in West German patent application (OLS) No. 2,062,925.

$R^2$ represents hydrogen, a halogen atom, an amino group, a hydroxy group, a mercapto group, an alkyl group, an alkoxy group, an aryloxy group, an alkylthio group, an arylthio group, an acyloxy group, an acylthio group, a heterocyclic ring group, and a formyl group, which may be substituted. $R^2$ may form a ring in combination with the carboxy group at the 3-position.

Suitable examples of the halogen atom are chlorine and bromine.

An example of the alkyl group is a methyl group. This alkyl group may be substituted by, for example, an acyloxy group (e.g., an acetoxy group), an alkoxy group (e.g., a methoxy group and a benzyloxy group), an aryloxy group (e.g., a phenoxy group), a hydroxy group, an amino group (e.g., a dimethylamino group), a halogeno group (e.g., fluorine and chlorine), an alkylthio group (e.g., an n-butylthio group and a benzylthio group), an arylthio group (e.g., a phenylthio group), a heterocyclic ring group (e.g., a pyridino group), a heterocyclic thio group (e.g., a 2-thiadiazolylthio group, and a 2-tetrazolythio group), an amido group (e.g., an acetamido group), and a carbamoyloxy group (e.g., a carbamoyloxy group, and a dimethylcarbamoyloxy group).

Suitable examples of the alkoxy group are a methoxy group and a benzyloxy group.

An example of the aryloxy group is a phenoxy group.

Examples of the alkylthio groups are a methylthio group and a benzylthio group.

An example of the arylthio group is a phenylthio group.

Examples of the acyloxy group are an acetoxy group and a benzoxy group.

An example of the acylthio group is an acetylthio group.

Heterocyclic ring groups which can be used are those described in connection with $R^1$.

In case that the substituent of $R^2$ contains a free amino, hydroxy, carboxy, sulfo, or like group, those compounds in which such groups can be protected by protective groups as described in connection with $R^1$ are included within the scope of this invention.

$R^3$ represents an alkali metal ion, an ammonium ion, a hydrocarbon group, or a heterocyclic group, which may be substituted. In more detail, examples of the alkali metal ion of $R^3$ are a sodium ion and a potassium ion; examples of the ammonium ion include organic amine salts, in addition to an ammonium ion, such as a trimethylammonium ion, a triethylammonium ion, a tetramethylammonium ion, and a tetrabutylammonium ion.

For the hydrocarbon groups and heterocyclic groups, those as described with respect to $R^1$ can be used. In particular, all groups which can be usually used as protective groups for the carboxy group can be used. Examples of such groups include a methyl group, an ethyl group, a propyl group, an isopropyl group, a tert-butyl group, a butyl group, a benzyl group, a diphenylmethyl group, a triphenylmethyl group, a trichloroethyl group, an acetoxymethyl group, a pivaloyloxymethyl group, an ethoxycarbonyloxyethyl group, a phthalimidomethyl group, and a succinimidomethyl group.

Particularly preferred from a standpoint of the effect of this invention among the compounds represented by formula (I) are those compounds in which $R^1$ is an amino group, an acylamino group, an alkoxycarbonylamino group, or an aryloxycarbonylamino group (which may be substituted) and particularly, is an amino group or an acylamino group (which may be substituted); $R^2$ is an alkyl group (which may be substituted); and $R^3$ is hydrogen, an alkali metal ion or an ammonium ion.

Representative examples of cephalosporins represented by formula (I) are as follows:

Compound 1 7-Aminocephalosporanic Acid
Compound 2 Deacetylcephalosporin C
Compound 3 Cefaloridine (INN*) (3-pyridinium methyl-7-(2-thionylacetamido)ceph-3-(4)-emoic acid)
Compound 4 Cefaloglycin (INN) (7-(D-α-aminophenylacetamido)cephalosporanic acid)
Compound 5 Cephalothin (7-(thiophene-2-acetamido)-cephalosporanic acid)
Compound 6 Cefalexin (INN) (7-(D-α-amino-α-phenylacetamido)-3-methyl-3-cephen-4-carboxylic acid)
Compound 7 7-(5-Carboxy-5-phthalimidobutyrylamido)-cephalosporanic Acid
Compound 8 7-Amino-3-(1-methyltetrazol-5-ylthiomethyl)-ceph-3-em-4-carboxylic Acid
Compound 9 Cefradine (INN)

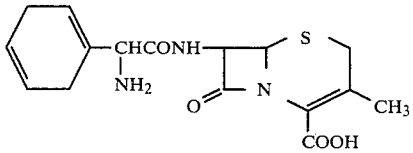

Compound 10 Cefacetrile (INN)

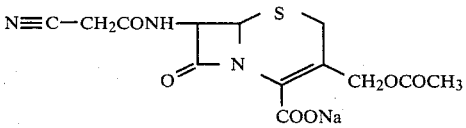

Compound 11 Cefazafur
Compound 12 Cefarolam (7-phenylacetamidocephalosporanic acid)
Compound 13 Cefoxazole
Compound 14 Cefolanide
Compound 15 Cefrotyl
Compound 16 7-(5-Carboxy-5-phthalimidobutyrylamido)-deacetylcephalosporic Acid -continued Compound 17 3-Acetoacetoxymethyl-7-amino-ceph-3-em-4-carboxylic Acid Compound 18 Cefaclor (INN)

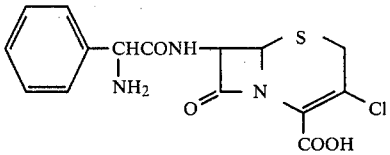

Compound 19 Cefatrizine (INN)

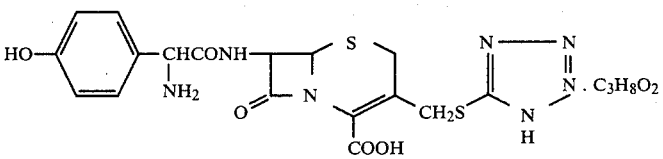

Compound 20 Cefadroxil (INN)

Compound 21 Cephaparol

Compound 22 Cephasmide

Compound 23 Cefamandole (INN)

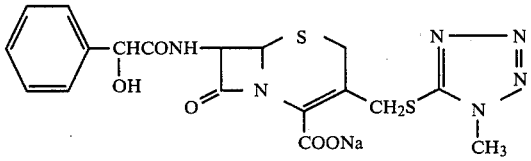

Compound 24 7-(5-Carboxy-5-phthalimidobutyrylamido)-3-(1-dimethylaminoethyltetrazole-5-ylthiomethyl)ceph-3-em-4-carboxylic Acid Compound 25 Cefsulodin (INN)

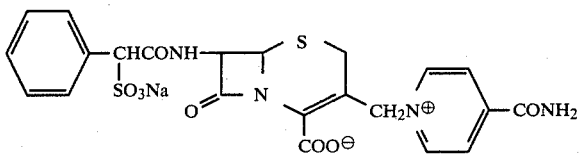

Compound 26 Cefazolin (INN) (7-[1-(1H)-tetrazolyl-acetamido]-3-[2-(5-methyl-1,3,4-thiazolyl-thiomethyl)]-$\Delta_3$-cephen-4-carboxylic acid)

Compound 27 Ceftezol (INN)

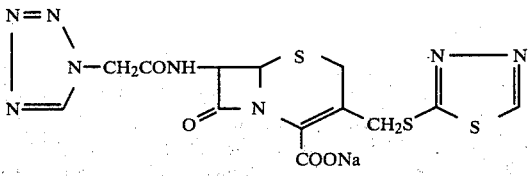

Compound 28 Cephacedone

Compound 29 Cefotiam (INN)

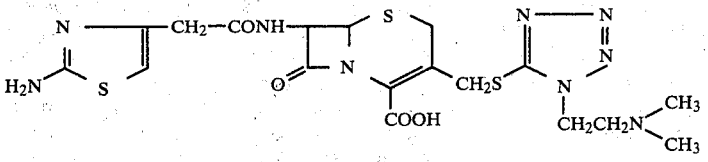

Compound 30 7-(5-Carboxy-5-phthalimidobutyrylamido)-3-(1-methyltetrazole-5-ylthiomethyl)ceph-3-em-4-carboxylic Acid Compound 31 Cefuroxime (INN)

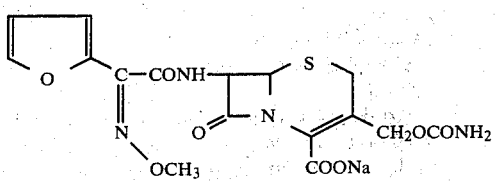

Compound 32 Cefotaxime (INN)

-continued

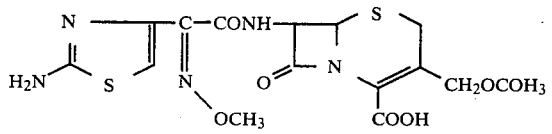

Compound 33 Cefapirin (INN)

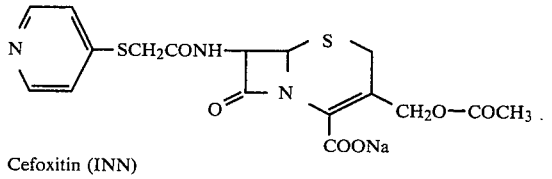

Compound 34 Cefoxitin (INN)

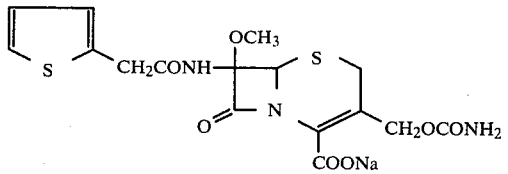

Compound 35 Cefmetazole (INN)

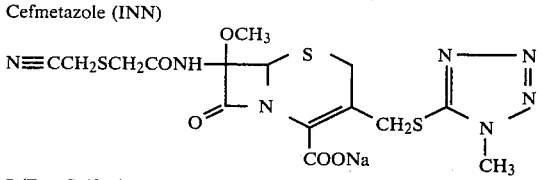

Compound 36 7-(D-α-Sulfophenylacetamido)cephalosporanic Acid
Compound 37 7-Amino-3-(1-dimethylaminoethyltetrazole-5-ylthiomethyl)ceph-3-em-4-carboxylic Acid
Compound 38 7-(2-Aminothiazole-4-ylacetamido)cephalosporic Acid
Compound 39 Cephalosporin C
Compound 40 7-Chloroacetylacetamidocephalosporanic Acid
Compound 41 7-Mandelamidocephalosporanic Acid
Compound 42 3-Acetoacetyloxymethyl-7-(D-α-sulfophenylacetamido)ceph-3-em-4-carboxylic Acid
Compound 43 7-Piperidinomethyleneaminocephalosporanic Acid
Compound 44 7-Acetoacetamido-3-acetoxymethylceph-3-em-4-carboxylic Acid
Compound 45 Sodium 3-Acetoxymethyl-7-{[2-(2,6-dimethylphenylamino)thiazole-4-yl]acetamido}ceph-3-em-4-carboxylate

*INN: International Nonproprietary Name

Methods of synthesizing the compounds represented by formula (I), inclusive of methods of synthesizing the compounds including the protective groups described above are described in the following literatures:

(1) E. P. Abraham, *Quart. Rev.*, 21, 231 (1967)
(2) E. Galantay et al., *J. Org. Chem.*, 29, 3560 (1964)
(3) J. C. Sheehan et al., *J. Org. Chem.*, 31, 1635 (1966)
(4) R. B. Woodward et al., *J. Am. Chem. Soc.*, 88, 852 (1966)
(5) R. B. Woodeard, *Science*, 153, 487 (1966)
(6) *Pharmacia*, 16, 479 (1980)
(7) E. H. Flym, *Cephalosporins and Penicillins, Chemistry and Biology*, Academic Press, New York (1972)

The compounds represented by formula (I) are generally called "cephalosporins", and many are commercially available.

The cephalosporin compound of this invention can be incorporated into any one or more of the hydrophilic colloid layers of a photographic light-sensitive element. It may be incorporated into either a photographic emulsion layer or a light-insensitive layer, for example, a protective layer, an intermediate layer, a filter layer, an antihalation layer or the like. Preferably, it is incorporated into a silver halide photographic emulsion layer.

The amount of the cephalosporin compound added is usually within the range of from about $5\times10^{-7}$ mol/mol Ag to $5\times10^{-2}$ mol/mol Ag ("mol Ag" refers to the mols of silver present in a light-sensitive form), and particularly preferably within the range of from about $5\times10^{-6}$ mol/mol Ag to $1\times10^{-2}$ mol/mol Ag.

While the cephalosporin compound of this invention may be added at any desired time, it is preferred that the cephalosporin compound be added after physical ripening and particularly at the stage of chemical ripening because it exhibits not only the latent image fading-preventing effect but also the sensitization effect. However, when the cephalosporin compound is added immediately before coating, after the chemical ripening, its sensitization effect is somewhat reduced although its latent image fading-preventing effect is sufficiently exhibited.

Addition of the cephalosporin compound of this invention to a photographic light-sensitive element can be performed by conventional methods which are used to add additives to a photographic emulsion. For example, when the cephalosporin compound is water-soluble, it is added as an aqueous solution having a suitable concentration, and when insoluble or sparingly soluble in water, it is dissolved in an organic solvent which is selected from water-miscible ones, such as alcohols, ethers, glycols, ketones, esters, and amides, and which exerts no adverse effect on photographic characteristics, and added as a solution to an emulsion. For this purpose, those well known methods which are used to add a waterinsoluble (so-called oil-soluble) coupler to an emulsion in the form of a dispersion can be employed.

Silver halide particles which are used in this invention are substantially of a surface latent image type; in other words, it is not substantially of an internal latent image type.

More specifically, "substantially of a surface latent image type" as used herein means that when a light-sensitive element prepared by coating an emulsion on a usual transparent support, said emulsion containing no compound represented by formula (I), is exposed to light for 1 to 1/100 second and then developed by Surface Development (A) and Internal Development (B) as hereinafter described, the sensitivity obtained by Surface Development (A) is greater than that obtained by Internal Development (B). The term "sensitivity" as used herein is defined as follows:

$$S = \frac{100}{Eh}$$

wherein S is sensitivity, and Eh is a light exposure amount required for obtaining a density of $\frac{1}{2}(D_{max}+D_{min})$, which is just intermediate between the maximum density, $D_{max}$, and the minimum density, $D_{min}$.

Surface Development (A)

A light-sensitive element is developed for 10 minutes at 20° C. by the use of a developer having the following formulation:

| | | |
|---|---|---|
| N-Methyl-p-aminophenol (Hemisulfate) | 2.5 | g |
| Ascorbic Acid | 10.0 | g |
| Sodium Metaborate Tetrahydrate | 35.0 | g |
| Potassium Bromide | 1.0 | g |
| Water to make | 1 | l |

Internal Development (B)

A light-sensitive element is treated at about 20° C. for 10 minutes in a bleaching solution containing 3 g/l of red prussiate and 0.0125 g/l of phenosafranine, washed with water for 10 minutes, and then developed for 10 minutes at 20° C. by the use of a developer having the following formulation:

| | | |
|---|---|---|
| N-Methyl-p-aminophenol (Hemisulfate) | 2.5 | g |
| Ascorbic Acid | 10.0 | g |
| Sodium Metaborate Tetrahydrate | 35.0 | g |
| Potassium Bromide | 1.0 | g |
| Sodium Thiosulfate | 3.0 | g |
| Water to make | 1 | l |

Silver halide in a silver halide light-sensitive element as used in this invention comprises silver chloride, silver chlorobromide, silver bromide, silver iodobromide or silver iodochlorobromide. While the average particle size of silver halide particles is not critical, it is preferably not greater than 3μ.

The silver halide emulsion is usually subjected to chemical sensitization although a so-called primitive emulsion, which is not subjected to chemical sensitization, can be used. For this chemical sensitization, those methods as described by Glafkides and Zelikman et al., and H. Frieser edit., *Die Grundlagen der Photographischen Prozesse mit Silberhalogeniden* (Akademische Verlagsgesellschaft, 1968) can be used. That is, a sulfur sensitization method in which thiosulfates, thioureas, thiazoles, rhodanines, etc., or active gelatin is used, a reduction sensitization method in which stannous salts, amines, hydrazines, formamidinesulfinic acid, silane compounds or the like are used, a noble metal sensitization method in which gold complex salts and complex salts of metals belonging to Group VIII of the Periodic Table, such as platinum, iridium, and palladium, are used, and so on can be used singly or in combination with each other.

Since the cephalosporin compound of this invention per se, as illustrated in Example 2 as hereinafter described, has a chemical sensitization action, it can also be used, singly or in combination with the abovedescribed known chemical sensitizers, in chemical ripening.

For the purposes of increasing sensitivity and contrast, and of accelerating development, for example, polyalkylene oxide or its derivatives, such as ethers, esters, and amines, thioether compounds, thiomorpholines, quaternary ammonium salt compounds, urethane derivatives, urea derivatives, imidazole derivatives, and 3-pyrazolidones may be incorporated. For example, those compounds as described in U.S. Pat. Nos. 2,400,532, 2,423,549, 2,716,062, 3,617,280, 3,772,021, 3,808,003, etc., can be used.

For the purpose of preventing fog from occurring in the course of production, storage, or photographic processing of a light-sensitive element, or of stabilizing photographic characteristics, various compounds can be incorporated. For example, the following compounds known as anti-foggants or stabilizers can be used: azoles, such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly, 1-phenyp-5-mercaptotetrazole); mercaptopyrimidines; mercaptotriazines; thioketo compounds, such as oxazolithione; azaindenes, such as triazaindenes, tetrazaindenes (particularly, 4-hydroxy-substituted(1,3,3a,7)tetrazaindenes), and pentazaindenes; and benzenesulfinic acid, benzenesulfonic acid amide, etc.

In this invention, it is advantageous to use gelatin as a binder for a photographic emulsion or as a protective colloid, but other hydrophilic colloids can be used. Hydrophilic colloids which can be used include proteins, such as gelatin derivatives, graft polymers of gelatin and other polymers, albumin, and casein; cellulose derivatives, such as hydroxyethyl cellulose, carboxymethyl cellulose, and cellulose sulfuric acid ester; sugar derivatives, such as sodium alginate, and starch derivatives; and a wide variety of synthetic hydrophilic homo- or copolymeric substances, such as polyvinyl alcohol, a partial acetal of polyvinyl alcohol, poly-N-vinyl pyrrolidone, polyacrylic acid, polymethacrylic acid, polyacrylamide, polyvinyl imidazole, and polyvinyl pyrazole.

Gelatin as used herein may be either limeprocessed gelatin or acid-processed gelatin. Additionally, a gelatin hydrolytic product and a gelatin enzymedecomposition product can be used.

The photographic emulsion layer and other hydrophilic colloid layers of the light-sensitive element of this invention may contain various known surface active agents as auxiliary coating agents or for the purposes of preventing electrification and adhesion, improving sliding properties, emulsification-dispersion, and photographic characteristics (for example, acceleration of development, an increase in contrast, and sensitization), and so forth.

Surface active agents which can be used include: nonionic surface active agents, such as saponin, alkylene oxide derivatives (e.g., polyethylene glycols, polyalkylene glycol alkyl amines or amides, and polyethylene oxide adducts of silicone), glycidol derivatives (e.g., alkenyl succinic acid polyglyceride), aliphatic acid esters of polyhydric alcohols, alkyl esters of sugar, urethanes, and ethers; anion surface active agents, such as triterpenoid-based saponin, alkylcarboxylic acid salts, alkylbenzenesulfonic acid salts, alkylsulfuric acid esters, alkylphosphoric acid esters, N-acyl-N-alkyltaurines, sulfosuccinic acid esters, and sulfoalkylpolyoxyethylene alkylphenyl ethers; amphoteric surface active agents, such as amino acids, aminoalkylsulfonic acids, aminoalkylsulfonic acid or aminoalkylphosphoric acid esters, alkylbetaines, amineimides, and amineoxides; and cation surface active agents, such as alkylamine salts, aliphatic or aromatic quaternary ammonium salts, heterocyclic quaternary ammonium salts, such as pyridinium, and imidazolium, and aliphatic or heterocyclic ring-containing phosphonium or sulfonium salts.

In the photographic light-sensitive element of this invention, the photographic emulsion layer and other hydrophilic colloid layers may contain therein a dispersion of a water-insoluble or water-sparingly soluble synthetic polymer for the purposes of improving dimension stability and so forth. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl ester (e.g., vinyl acetate), acrylonitrile, olefin, and styrene, and copolymers of the above monomers and acrylic acid, methacrylic acid, $\alpha,\beta$-unsaturated dicarboxylic acid, hydroxyalkyl acrylate or methacrylate, sulfoalkyl acrylate or methacrylate, styrenesulfonic acid, etc.

Furthermore, the photographic emulsion layer and other hydrophilic colloid layers may contain therein an inorganic or organic hardener. As such hardeners, chromium salts (e.g., chromium alum and chromium acetate), aldehydes (e.g., formaldehyde, glyoxal, glutaraldehyde), N-ethylol compounds (e.g., dimethylol urea and methyloldimethylhydantoin), dioxane derivatives (e.g., 2,3-dihydroxydioxane), active vinyl compounds (e.g., 1,3,5-triacryloyl-hexahydro-S-triazine and bis(vinylsulfonyl) methyl ether), active halogen compounds (e.g., 2,4-dichloro-6-hydroxy-S-triazine), mucohalogenic acids (e.g., mucochloric acid and mucophenoxychloric acid), isooxazoles, dialdehyde starch, 2-chloro-6-hydroxytriazinylated gelatin, and the like can be used, singly or in combination with each other.

The photographic emulsion of this invention may be spectral sensitized by methine dyes and the like. Dyes which can be used include cyanine dye, merocyanine dye, complex cyanine dye, complex merocyanine dye, holopolar cyanine dye, hemicyanine dye, styryl dye and hemioxonol dye. Particularly useful dyes are merocyanine dyes and complex merocyanine dyes. These dyes can include any nuclei which are known to be utilized in cyanine dyes and basic heterocyclic nuclei.

Basic heterocyclic nuclei which can be used include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei in which an alicyclic hydrocarbon ring is condensed together with the above-described nuclei; and nuclei in which an aromatic hydrocarbon ring is condensed together with the above-described nuclei, such as an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, and a quinoline nucleus.

The merocyanine dye or complex merocyanine dye can include, as a nucleus having the ketomethylene structure, a 5- or 6-membered heterocyclic nucleus, such as a pyrazoline-5-one nucleus, a thiohydantoin nucleus, a 2-thioxazolidine-2,4-dione nucleus, a thiazolidine-2,4-dione nucleus, a rhodanine nucleus, and a thiobarbituric acid nucleus.

In the light-sensitive element of this invention, the hydrophilic colloid layer may contain therein a water-soluble dye (e.g., oxonol dye, hemioxonol dye, styryl dye, merocyanine dye, cyanine dye, and azo dye) as a filter dye or for the purposes of prevention of irradiation and so forth.

The photographic emulsion of this invention may contain therein a color image-forming coupler, i.e., a compound which forms a dye upon reacting with an oxidation product of an aromatic amine (usually, a primary amine) developing agent.

In one preferred embodiment, the coupler has a hydrophobic group, referred to as a ballast group, in the molecule thereof, and is non-diffusible. The coupler may be either a 4-equivalent coupler or a 2-equivalent coupler. Furthermore, the photographic emulsion of this invention may contain therein a colored coupler having the color correction effect, or a coupler (referred to as a DIR coupler) releasing a development inhibitor as the development proceeds. The coupler may be a coupler which provides a colorless coupling reaction product.

As yellow color-forming couplers, known closed ketomethylene based couplers can be used. Among these couplers, benzoylacetoanilide- and pivaloylacetoanilide-based compounds are advantageously used.

Magenta couplers which can be used include pyrazolone based compounds, indazolone based compounds, and cyanoacetyl compounds. Particularly advantageous among these compounds are pyrazolone based compounds.

Cyan couplers which can be used include phenol based compounds and naphthol based compounds.

DIR couplers which can be used include those described, for example, in U.S. Pat. Nos. 3,227,554, 3,617,291, 3,701,783, 3,790,384, and 3,632,345, West German patent application (OLS) Nos. 2,414,006, 2,454,301, and 2,454,329, British Pat. No. 953,454, and Japanese patent application (OPI) No. 69624/77.

In addition to the DIR coupler, a compound which releases a development inhibitor as the development proceeds may be incorporated into the light-sensitive element of this invention. Examples of such compounds are described, for example, in U.S. Pat. Nos. 3,297,445 and 3,379,529, and West German patent application (OLS) No. 2,417,914.

Two or more of the above-described couplers can be incorporated into the same layer. The same coupler may be incorporated into two or more different layers.

The light-sensitive element of this invention may contain, as a color fog-preventing agent, a hydroquinone derivative, an aminophenol derivative, a gallic acid derivative, an ascorbic acid derivative, or the like.

Furthermore, the light-sensitive element of this invention may contain in its hydrophilic colloid layer an ultraviolet ray-absorbing agent, such as a benzotriazole compound which is substituted by an aryl group, a 4-thiazolidone compound, a benzophenone compound, a cinnamic acid ester compound, or a benzoxazole compound.

The photographic emulsion of this invention is coated on a flexible support, such as a plastic film (e.g., cellulose nitrate, cellulose acetate, and polyethylene terephthalate) and paper, or on a rigid support, which are usually used in production of photographic light-sensitive elements.

A multilayer, multicolor photographic element having at least two different sensitivities is included within the scope of this invention. Typically, the multilayer, multicolor photographic element comprises a support and at least one layer of each of a red-sensitive emulsion layer, a green-sensitive emulsion layer, and a blue-sensitive emulsion layer, provided on the support. The order in which the emulsion layers are provided on the support is not critical to this invention, and they can be arranged as desired based on other conventional considerations. Typically, the layers are coated on the support in the order: red-sensitive emulsion layer, green-sensitive emulsion layer, and blue-sensitive emulsion layer, containing therein a cyan-forming coupler, a magenta-forming coupler, and a yellow-forming coupler, respectively. For particular uses, different combinations can be employed.

Light-exposure to obtain a photographic image in this invention can be performed by known methods. For this light-exposure, various known light sources, such as natural light (sunlight), a tungsten lamp, a fluorescent lamp, a mercury lamp, a xenon arc lamp, a carbon arc lamp, a xenon flash lamp, and a cathode flying spot, can be employed. Light-exposure time may be, of course, within the range of from 1/1,000 second to 1 second which is typical for a camera. Furthermore, light-exposure times of shorter than 1/1,000 second, for example, about $1/10^4$ to $1/10^6$ second when a xenon flash lamp or a cathode ray tube is used, and of longer than 1 second, can be used.

The light-sensitive element of this invention can be processed by conventional methods using known processing solutions. The processing temperature is usually selected within the range of from about 18° C. to about 50° C. However, temperatures lower than 18° C. and temperatures higher than 50° C. can be employed. According to the purpose, either a black-white photographic processing or a color photographic processing can be used.

A developer for use in black-white photographic processing can contain therein a known developing agent. Developing agents which can be used include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds as described in U.S. Pat. No. 4,067,872 wherein a 1,2,3,4-tetrahydroquinoline ring and an indolene ring are condensed together. These developing agents can be used alone or in combination with each other.

Generally, the developer may further contain therein known preservatives, alkali agents, pH buffers, anti-foggants, etc., and, if desired, auxiliary dissolving agents, color-controlling agents, development accelerators, surface active agents, defoaming agents, hard water-softening agents, hardeners, tackifiers, etc.

As fixers, known fixer compositions can be used. Fixing agents which can be used include thiosulfuric acid salts and thiocyanic acid salts. Additionally, organic sulfur compounds which are known to have the effect as a fixing agent can be used. The fixer may contain therein a water-soluble aluminum salt as a hardener.

A dye image can be formed by conventional methods. For example, a negative-positive process (as described, for example, in *Journal of the Society of Motion Picture and Television Engineers,* Vol. 61, pages 667 to 701 (1953)), a color reversal process in which a negative silver image is formed by developing with a developer containing therein a black-white developing agent, then subjected to at least one uniform light-exposure or to another suitable fog-producing processing, and subsequently is color-developed to obtain a positive dye image, and a silver dye bleaching process in which a photographic emulsion layer containing therein a dye is exposed to light and then developed to form a silver image, and the dye is bleached by the use of the silver image as a bleaching catalyst can be used.

A color developer generally comprises an alkaline aqueous solution containing therein a color developing agent. Color developing agents which can be used include known primary aromatic amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline).

Additionally, color developing agents as described in L. F. A. Mason, *Photographic Processing Chemistry,* Focal Press, pages 226 to 229 (1966), U.S. Pat. Nos. 2,193,015 and 2,592,364, Japanese patent application (OPI) No. 64933/73, etc., can be used.

The color developer can contain therein pH buffers, such as sulfurous acid salts, carbonic acid salts, boric acid salts, and phosphoric acid salts, development inhibitors, such as bromide and iodide, anti-foggants, etc. Furthermore, if desired, a hard water-softening agent, a preservative, such as hydroxyamine, an organic solvent, such as benzyl alcohol and diethylene glycol, a development accelerator, such as polyethylene glycol, a quaternary ammonium salt, and an amine, a dye-forming coupler, a competition coupler, a fogging agent, such as sodium borohydride, an auxiliary developing agent, such as 1-phenyl-3-pyrazolidone, a tackifier, a polycarboxylic acid-based chelating agent as described in U.S. Pat. No. 4,083,723, an antioxidant as described in West German patent application (OLS) No. 2,622,950, etc., can be incorporated thereinto.

After the color development, the photographic emulsion layer is usually subjected to a bleach processing.

The bleach processing may be performed simultaneously with a fixation processing, or separately therefrom.

Bleaching agents which can be used include multivalent metal (e.g., iron (III), cobalt (III), chromium (VI), and copper (II)) compounds, peracids, quinones, and nitroso compounds. For example, ferricyanides, dichromic acid salts, organic complex salts of iron (III) or cobalt (III), and complex salts of aminopolycarboxylic acids, such as ethylenediaminetetraacetic acid, nitrilotriacetic acid, and 1,3-diamino-2-propanoltetraacetic acid, and organic acids, such as citric acid, tartaric acid, and malic acid; persulfuric acid salts, and permanganic acid salts; nitrosophenol; etc., can be used.

Of these compounds, potassium ferricyanide, iron (III) sodium ethylenediaminetetraacetate, iron (III) ammonium ethylenediaminetetraacetate, and potassium ferricyanide are particularly useful. Ethylenediaminetetraacetic acid iron (III) complex salts are useful either in an independent bleaching solution or in a combined bleach-fixing solution.

To the bleach or bleach-fixing solution there can be added bleach accelerators as described in U.S. Pat. Nos. 3,042,520 and 3,241,966, Japanese Patent Publication Nos. 8506/70 and 8836/70, etc., thiol compounds as described in Japanese patent application (OPI) No. 65732/78, and other various additives.

Photographic light-sensitive elements containing cephalosporins according to this invention are not only markedly prevented in the latent image fading, but also are chemically sensitized. Photographic light-sensitive elements of this invention, therefore, are suitable for use as, in particular, projection light-sensitive elements (e.g., a black-white negative film, a color negative film, and a reversal film). Of course, they can be used in other applications (e.g., a black-white or color printing paper).

The following examples are provided to illustrate this invention in greater detail.

EXAMPLE 1

To a silver iodobromide emulsion (average particle size of about 0.75μ) containing 7.5 mol% of silver iodide were added 9.8 mg/mol-Ag of sodium thiosulfate and 6.8 mg/mol-Ag of potassium chloroaurate, and the resulting mixture was then aged at 60° C. for 50 minutes.

The emulsion thus-obtained was divided into 14 portions.

To each portion there was added:

a cephalosporin compound of this invention or 6-aminopenicillanic acid (as described in British Pat. No. 1,389,089) as described in Table 1;

3.3 g/mol-Ag of 4-hydroxy-6-methyl-1,3,3a,7-tetrazaindene (stabilizer);

2.4 g/mol-Ag of 2,4-dichloro-6-hydroxy-1,3,5-triazine sodium salt (hardener); and 0.9 g/mol-Ag of sodium dodecylbenzenesulfonate (auxiliary coating agent), in that sequence. The resulting mixture was coated on a triacetyl acetate film to obtain a light-sensitive element sample.

The light-sensitive element sample thus-obtained was then exposed to light through an optical wedge manufactured by Fuji Photo Film Co., Ltd. for 1/100 second, developed at 20° C. for 7 minutes with Kodak D-72 developer, and thereafter, was fixed, washed with water, and dried in a conventional manner.

The relative sensitivity when the light-sensitive element sample was developed just after the light-exposure, and the relative sensitivity when such an element was developed after being allowed to stand at room temperature (20° C. to 25° C.) for 21 days after the light-exposure are shown in Table 1. By comparing these relative sensitivity values, the extent of the latent image fading can be seen.

In Table 1, the relative sensitivity is a reciprocal relative value of a light-exposure amount required to obtain an intensity of 0.2 more than the fog level. The relative sensitivity of Sample No. 1 when developed just after the light-exposure was designated as 100.

It can be seen from Table 1 that Sample No. 13 of the prior art has the same relative sensitivity after ripening as control and has no effect of reducing latent image regression under this ripening condition; even when the amount of 6-aminopenicillanic acid was increased, only a small improvement was noted; on the other hand, addition of the cephalosporin compounds of this invention results in a very stable latent image. Furthermore, it has been found that the addition of the cephalosporin compounds of this invention increases the sensitivity of the resulting light-sensitive elements.

It is believed there is no specific reason that one skilled in the art expect other cephalosporin compounds would behave otherwise than the above-tested compounds.

EXAMPLE 2

In order to examine the unexpected sensitization effect of cephalosporin compounds, the following experiment was designed.

A silver iodobromide emulsion (average particle size: about 0.9μ) containing 2.5 mol% of silver iodide was adjusted to pAg 8.9. To this silver iodobromide emulsion were added 3.5 mg of potassium chloroaurate and 0.15 g of rhodan ammonium, per mol of silver halide, and the resulting mixture was then aged at 60° C. for 65 minutes.

The emulsion thus obtained was divided into 5 portions. To each portion were added a compound as described in Table 2 and the same stabilizer, hardener and auxiliary coating agent as used in Example 1, and the resulting mixture was coated on a support to obtain a light-sensitive element sample.

The light-sensitive element sample thus-obtained was processed in the same manner as in Example 1. The results are shown in Table 2.

In Table 2, the relative sensitivity is a reciprocal relative value of a light-exposure amount required to obtain an intensity of 0.2 more than the fog level. The relative sensitivity of Sample No. 102 when developed just after the light-exposure was designated as 100.

It can be seen from considering Tables 1 and 2 that the cephalosporin compounds of this invention, when used at the time of chemical ripening, exhibit the sensitization effect which is nearly equal to that of a well known chemical sensitizer, sodium thiosulfate (Sample No. 102), although it is necessary to add them in somewhat greater amounts than sodium thiosulfate, as well as that they exhibit the effect of greatly inhibiting latent image fading.

TABLE 1

| Sample No. | Compound No. | Amount mol/mol AgX | Relative Sensitivity when Developed just after Light-Exposure | Relative Sensitivity when Developed after Standing at Room Temperature for 21 Days after Light-Exposure |
|---|---|---|---|---|
| 1 | None (control) | — | 100 | 75 |
| 2 | 1 | $1.5 \times 10^{-5}$ | 102 | 98 |
| 3 | 43 | $4.5 \times 10^{-6}$ | 102 | 95 |
| 4 | " | $1.1 \times 10^{-5}$ | 110 | 108 |
| 5 | 10 | $2.3 \times 10^{-5}$ | 105 | 100 |
| 6 | 3 | $1.1 \times 10^{-5}$ | 105 | 104 |
| 7 | 5 | $4.5 \times 10^{-6}$ | 100 | 100 |
| 8 | 6 | $1.1 \times 10^{-5}$ | 112 | 110 |
| 9 | 25 | $1.1 \times 10^{-5}$ | 108 | 108 |
| 10 | 29 | $1.1 \times 10^{-5}$ | 109 | 105 |
| 11 | 39 | $1.1 \times 10^{-5}$ | 103 | 100 |
| 12 | " | $1.0 \times 10^{-4}$ | 118 | 118 |
| 13 | 6-APA* | $1.8 \times 10^{-6}$ | 100 | 75 |
| 14 | " | $0.9 \times 10^{-4}$ | 100 | 82 |

*6-APA: 6-Aminopenicillanic Acid

TABLE 2

| Sample No. | Compound Added | Amount mol/mol AgX | Relative Sensitivity when Developed just after Light-Exposure | Relative Sensitivity when Developed after Allowing to Stand at Room Temperature for 21 Days after Light-Exposure |
|---|---|---|---|---|
| 101 | Control (no addition) | — | 25 | 18 |
| 102 | $Na_2S_2O_3$ (comparison) | $3 \times 10^{-5}$ | 100 | 71 |
| 103 | 1 (invention) | $1.4 \times 10^{-4}$ | 98 | 95 |
| 104 | 43 (invention) | $1.2 \times 10^{-4}$ | 98 | 96 |
| 105 | 10 (invention) | $2.1 \times 10^{-4}$ | 95 | 93 |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising a support, at least one silver halide emulsion layer which is substantially of the surface latent image type, and at least one hydrophilic colloid layer, wherein at least one of the silver halide emulsion layer and the hydrophilic colloid layer contains a cephalosporin compound in an amount sufficient to reduce latent image regression, wherein the cephalosprin compound has the following formula:

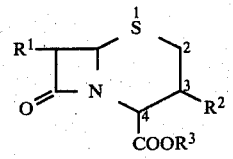

(I)

wherein $R^1$ represent an amino group;

$R^2$ can represent hydrogen, a halogen group, an amino group, a hydroxy group, a mercapto group, an alkyl group, an alkoxy group, an aryloxy group, an alkylthio group, an arylthio group, an acyloxy group, an acylthio group, a heterocyclic group, or a formyl group; and $R^3$ can represent hydrogen, an alkali metal ion, an ammonium ion, or a hydrocarbon or heterocyclic group which may be substituted; or $R^2$ and $R^3$ together can represent a group completing an oxygen-containing heterocyclic group.

2. A silver halide photographic light-sensitive element as in claim 1, wherein $R^1$ represents an amino group substituted with at least one substituent selected from hydrocarbon groups and amino protective groups.

3. A silver halide photographic light-sensitive element as in claim 2, wherein $R^1$ represents an amino group substituted with at least one amino protective group.

4. A silver halide photographic light-sensitive element as in claim 3, wherein said amino protective group is an acyl group.

5. A silver halide photographic light-sensitive element as in claim 1, 2, 3, or 4, wherein said silver halide emulsion layer contains the cephalosporin compound.

6. A silver halide photographic light-sensitive element as in claim 1, 2, 3, or 4, wherein the amount of cephalosporin compound is from about $5\times10^{-7}$ mol/mol Ag to $5\times10^{-2}$ mol/mol Ag.

7. A silver halide photographic light-sensitive element as in claim 1, 2, 3, or 4, wherein the amount of cephalosporin compound is from about $5\times10^{-6}$ mol/mol Ag to $1\times10^{-2}$ mol/mol Ag.

8. A silver halide photographic light-sensitive element as in claim 5, wherein the amount of cephalosporin compound is from about $5\times10^{-7}$ mol/mol Ag to $5\times10^{-2}$ mol/mol Ag.

9. A silver halide photographic light-sensitive element as in claim 5, wherein the amount of cephalosporin compound is from about $5\times10^{-6}$ mol/mol Ag to $1\times10^{-2}$ mol/mol Ag.

10. A silver halide photographic light-sensitive element as in claim 1, 2, 3 or 6, wherein the amount of said cephalosporin compound is from about $4.5\times10^{-6}$ to $1.0\times10^{-4}$ mol/mol Ag.

* * * * *